US005101645A

United States Patent [19]

Malchow

[11] Patent Number: 5,101,645

[45] Date of Patent: Apr. 7, 1992

[54] SUSPENSION SYSTEM FOR AUTOMATIC WASHING MACHINE

[75] Inventor: Gregory L. Malchow, Oshkosh, Wis.

[73] Assignee: Speed Queen Company, Ripon, Wis.

[21] Appl. No.: 687,355

[22] Filed: Apr. 18, 1991

[51] Int. Cl.[5] ..... D06F 37/24

[52] U.S. Cl. ..... 68/23.3; 210/364; 248/638

[58] Field of Search ..... 68/23.3; 210/144, 364; 248/638

[56] References Cited

U.S. PATENT DOCUMENTS 2,746,569 5/1956 Castner ..... 210/364 X
4,174,622 11/1979 Bonnell et al. ..... 68/23.3
4,475,363 10/1984 Thomson ..... 248/638 X

FOREIGN PATENT DOCUMENTS 3229096 9/1988 Japan ..... 68/23.3
686803 1/1953 United Kingdom ..... 68/23.3

*Primary Examiner*—Philip R. Coe
*Attorney, Agent, or Firm*—William R. Clark; Richard M. Sharkansky

[57] ABSTRACT

A suspension system for an automatic washing machine wherein multiple independent modes of motion are provided, and the springs biasing the respective modes are selected so that the critical frequencies (i.e. maximum excursions) of the modes do not occur simultaneously. For example, a first set of centering springs biases a traversing motion and a second set of upstanding springs biases a pivoting motion. The spring rates are selected so that as the spin tub accelerates, the maximum excursion of one of the modes occurs first followed by the maximum excursion of the other mode at a higher spin tub speed.

26 Claims, 3 Drawing Sheets

FIG. 4
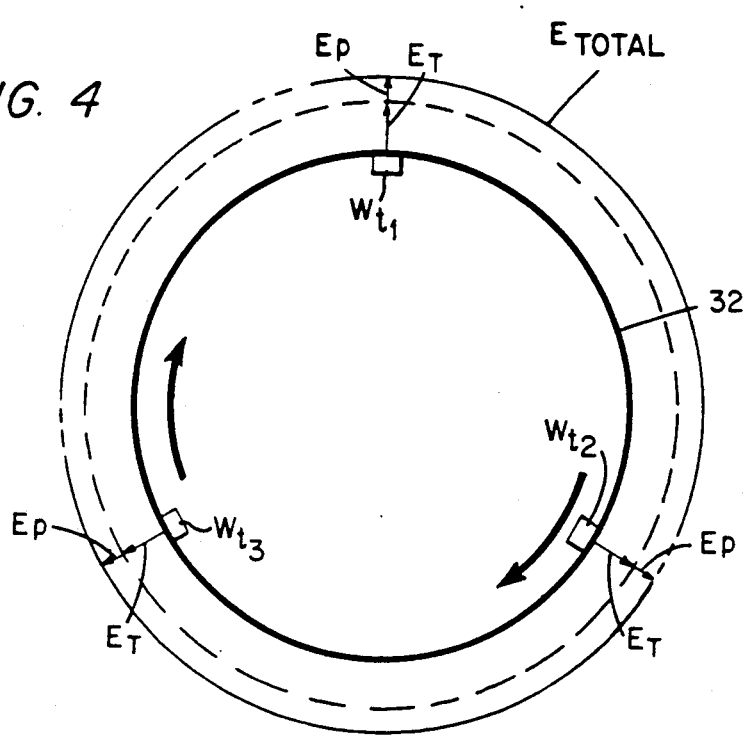
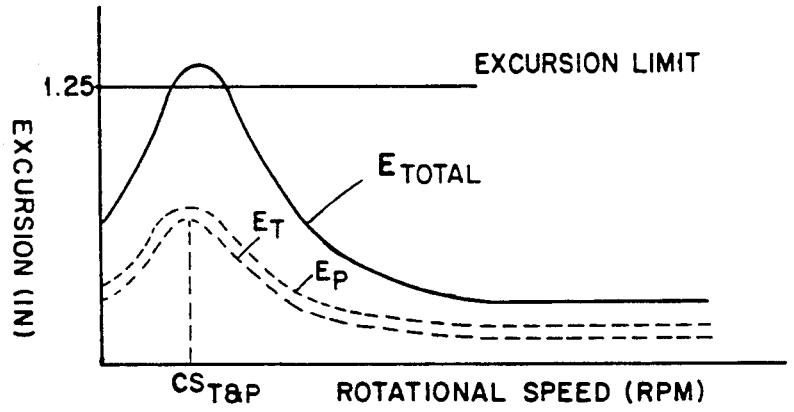
FIG. 5
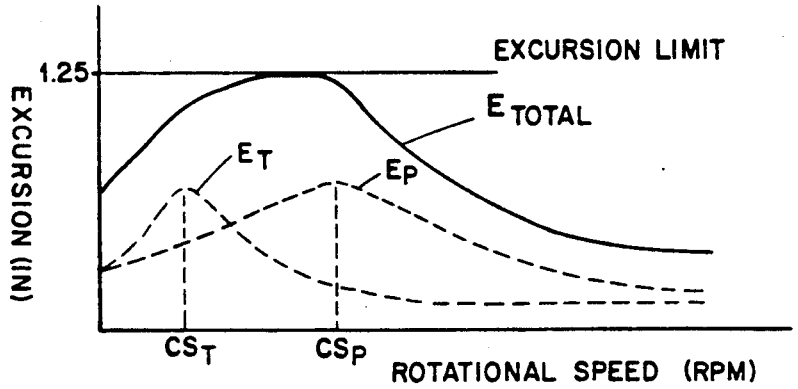
FIG. 6

SUSPENSION SYSTEM FOR AUTOMATIC WASHING MACHINE

BACKGROUND OF THE INVENTION

The field of the invention generally relates to automatic washing machines, and more particularly relates to washer suspensions that have multiple modes of motion.

As is well known, a typical automatic washing machine sequences through a spin cycle after completion of a wash or rinse cycle. During a spin cycle, the agitator and the perforated clothes basket are accelerated up to high speed rotation to extract moisture from the clothes by centrifugal force. When the clothes are unevenly or nonuniformly distributed around the walls of the clothes basket, out-of-balance forces are created. When these forces are transmitted to the base, or more particular the feet of the washing machine, undesirable vibration may occur and, in extreme cases, the washing machine may actually "walk".

A primary objective of a washing machine suspension is to minimize the out-of-balance or unbalance forces that are transmitted to the base. In particular, it is important to minimize the vertical forces transmitted to the feet because these are the dominant forces responsible for walking. Generally, a washer suspension system absorbs these out-of-balance forces by permitting the tub assembly to move resiliently within the cabinet. A somewhat conflicting objective of a suspension system is to limit the excursion of the tub assembly because an unduly large free motion envelope around the tub assembly necessitates an unduly large cabinet size. It is well understood that even though the maximum rotational speed may typically be 600–700 rpm, the maximum excursion generally occurs at a much lower rotational speed called the critical speed or frequency. For example, the critical speed may typically occur on the order of 100 rpm when the out-of-balance forces tend to be regenerative. Once through the critical speed, the excursion, or lateral distance of tub assembly motion, decreases.

In the most common type of upright automatic washing machine, the tub assembly is supported on a suspension system that has a fixed pivot point relatively close to the floor, and springs with relatively high rate (force needed to deflect per unit of distance) are used to bias the tub assembly towards its vertical or upright axis. When large out-of-balance forces exist, the tub assembly tilts from the fixed pivot point and moves in a circular motion. Such a suspension generally requires a relatively large cabinet to prevent mechanical interference that could cause collision damage to the cabinet or other components; alternatively, very high rate springs can be used, but such arrangement tends to lead to extreme vibration and walking.

Another type of washing machine suspension is described in U.S. patent application Ser. No. 633,816 filed Dec. 26, 1990. In the apparatus described therein, the tub assembly is supported at a mid-level of the washing machine, and the suspension permits motion of the tub assembly in two independent modes or characteristics. More specifically, an annular traversing member is supported on a mid-level support surface, and is free to traverse in sliding engagement in the horizontal or x,y plane. Further, the tub assembly has a downward extending dome that sits on a complimentary surface of the annular traversing member such that the tub assembly can pivot or tilt. Thus, the tub assembly can independently traverse or pivot. One set of springs is arranged to bias the tub assembly towards the center, and another set of springs urges the tub assembly towards its upright orientation. With such arrangement, the pivoting forces are reduced by the addition of the traversing motion, and lower pivoting forces result in lower vertical forces being transmitted to the feet. Thus, the washing machine has minimal tendency to walk. The pivoting forces are further reduced by providing a tub assembly that has a dynamic center of mass above the pivot point, and preferably at the approximate level of the out-of-balance weight which typically is 2 to 4 inches above the bottom of the clothes basket. In fact, when the dynamic center of mass coincides with the vertical level of the out-of-balance weight, the pivoting forces are theoretically zero. Thus, the only vertical forces on the feet would be moment forces resulting from the traversing motion. However, because the dynamic center of mass and the out-of-balance weight are both above the pivot point, the traversing and pivoting excursions generally occur in the same instantaneous radial direction, and therefore are additive. Thus, the cabinet has to be made large enough to accommodate a motion envelope for the additive excursions (i.e. traversing and pivoting).

SUMMARY OF THE INVENTION

It is an object of the invention to provide an improved suspension system for an upright automatic washing machine.

It is also an object to provide a washer suspension system that effectively limits the out-of-balance forces transmitted to the base, and particularly limits the vertical forces transmitted to the feet so as to prevent walking or extreme vibration.

It is a further object to provide a washing machine suspension wherein the tub assembly has freedom of movement in multiple independent modes or characteristics of motions.

It is a further object to provide a washing machine suspension that permits the tub assembly to traverse, and also to pivot.

It is also an object to have a tub assembly that has a dynamic center of mass above the pivot point, and more particularly at the approximate vertical level as an out-of-balance weight.

It is a further object to provide a suspension system that can be used with a relatively small outer cabinet. That is, it is an object to provide a suspension system that minimizes the total instantaneous radial excursion while effectively limiting the out-of-balance forces transmitted to the base.

These and other objects and advantages are provided by a suspension system adapted for supporting a tub assembly comprising a spin tub disposed in an outer tub within a washing machine wherein the spin tub is accelerated to a predetermined high speed rotation during a spin cycle of the washing machine. In accordance with the invention, the suspension system comprises means for permitting motion of the tub assembly in first and second modes, and means for biasing motion of the tub assembly in the first and second modes so that the maximum excursion of the first mode occurs at a different spin tub rotational speed than maximum excursion of the second mode. It is preferable that the first mode permitting means comprise means for traversing the tub assembly in a substantially horizontal plane and that the second mode permitting means comprise means for pivoting the tub assembly. It is preferable that the tub assembly have a dynamic center of mass disposed above a pivot point of the pivoting motion. It is further preferable that the first and second mode biasing means comprise a first set of springs for biasing the tub assembly towards a predetermined location on a horizontal plane and a second set of springs for biasing the tub assembly towards an upright orientation. The first and second sets of springs may preferably have different spring rates to provide different critical speeds for said first and second modes.

The invention may also be practiced by a suspension system comprising a support surface, a traversing member comprising a collar supported in sliding engagement on the support surface wherein the collar comprises means for pivotally supporting the tub assembly, means comprising a first set of springs for biasing the tub assembly towards a central position on the support surface, means comprising a second set of springs for biasing the tub assembly towards an upright orientation wherein the first and second sets of springs comprise means for providing substantially different critical speeds for traversing and pivoting to provide maximum excursion of traversing at a different tub speed than maximum excursion of pivoting. It is preferable that the system further comprise means for elevating the support surface above the base of a washing machine, such elevating means preferably comprising upstanding legs. In one arrangement, it is preferable that the upstanding springs and centering springs connect from the legs to the tub assembly. The higher of the critical speeds may preferably be 25% higher than the lower critical speed, and also, the critical speeds may preferably be separated by more than 10 rpm. In one preferred arrangement, the lower critical speed may be less than 50 rpm while the higher critical speed is greater than 60 rpm.

With such arrangement, the excursions of the respective traversing and pivoting motions are managed so that the maximum excursions do not occur at the same time (i.e. the same spin tub speed). Thus, the maximum total excursion is minimized because the maximum independent excursions do not occur simultaneously. As a result, improved suspension performance is provided without having an unduly large cabinet.

BRIEF DESCRIPTION OF THE DRAWINGS

The foregoing objects and advantages will be more fully understood by reading the following description of the preferred embodiment with reference to the drawings wherein:

FIG. 4 is a pictorial diagram showing the directions of the traversing excursion $E_T$ and pivoting excursion $E_P$ with the dynamic center of mass above the pivot point;

FIG. 5 is an illustrative plot showing the tub assembly excursion versus spin tub rotational speed when the critical speed of the traversing motion and pivoting motion occur at the same rotational speed; and FIG. 6 is an illustrative plot showing the tub excursion versus spin tub rotational speed when the critical speed of the traversing motion occurs at a different rotational speed than the critical speed for pivoting motion.

DESCRIPTION OF THE PREFERRED EMBODIMENTS

Figure 1:
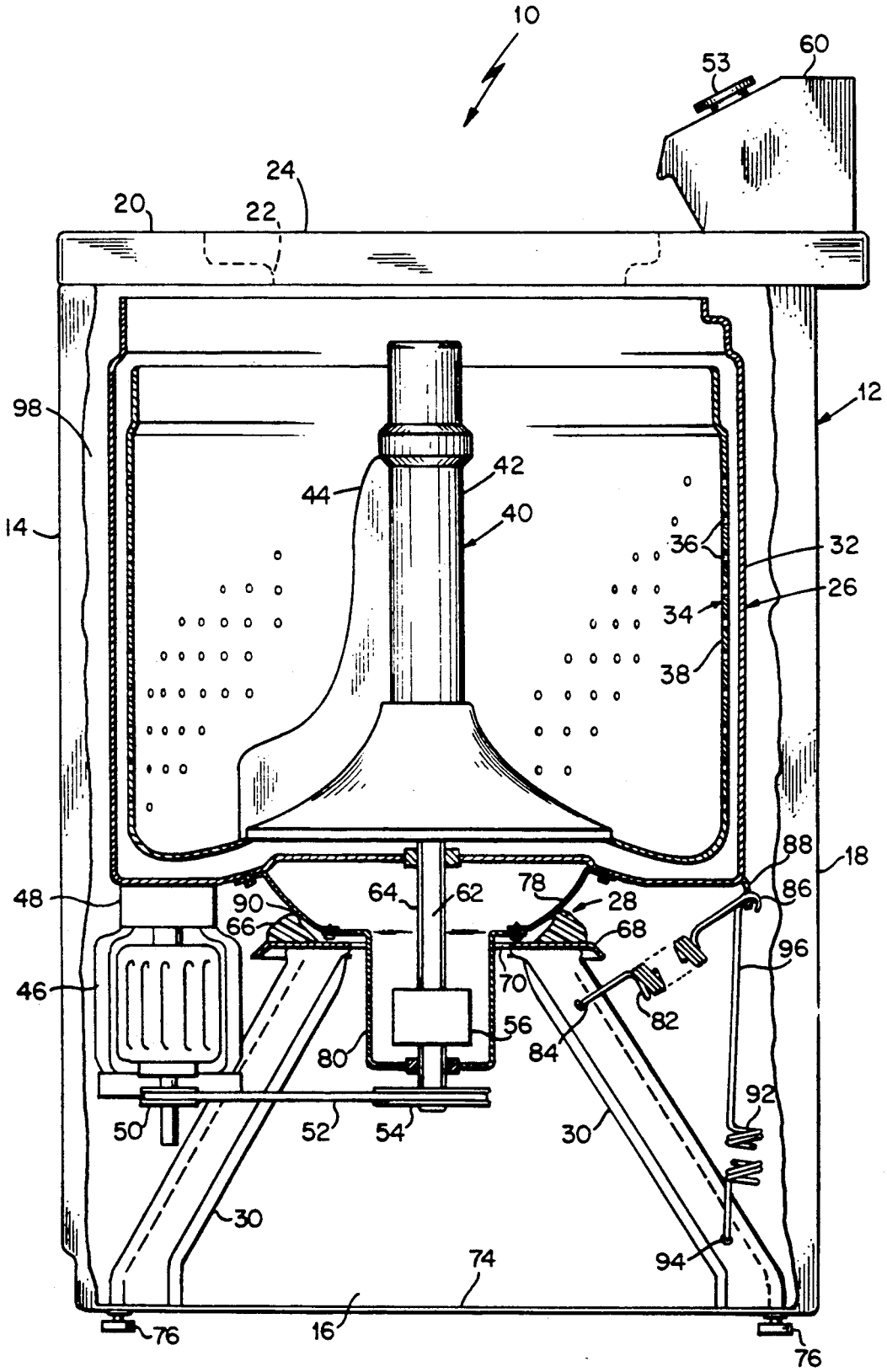
FIG. 1 is a partially broken away side view of a top loading automatic washing machine.

Referring to the drawings wherein like numerals refer to like parts throughout the several views, FIG. 1 shows a partially broken away side view of a top loading automatic clothes washer 10. Clothes washer 10 is encased in outer cabinet 12 which includes a front panel 14, two side panels 16, a rear panel 18, and a top panel 20 which has an access opening 22 covered by lid 24.

Tub assembly 26 is disposed in cabinet 12 and is supported by a mid-level suspension 28 that is elevated by upstanding legs 30 to an approximate mid-level region of cabinet 12. Tub assembly 26 includes a drain or outer tub 32 in which spin tub 34 o clothes basket is concentrically positioned. As is conventional, spin tub 34 has a plurality of perforations 36 in sidewall 38. Centrally located within spin tub 34 is an agitator 40 including an agitator post 42 with vanes 44.

Here, tub assembly 26 further includes motor 46 which is mounted to the underside of outer tub 32 by bracket 48. Motor 46 has a drive pulley 50 which is coupled by belt 52 to driven pulley 54 which drives transmission 56.

In operation, clothes (not shown) are loaded into spin tub 34 through access opening 22 and, after suitable controls are set by control knob 58 on control console 60, outer tub 32 is filled with water which passes through perforations 36 into spin tub 34. Next, the agitator 40 is driven back and forth through a predetermined arc to agitate the clothes to remove soil. In one embodiment, motor 46 is driven unidirectionally during the agitation mode, and transmission 56 functions to provide reciprocating motion of a suitable speed to agitator drive shaft 62 to drive agitator 40 reciprocally. In an alternate embodiment, motor 46 may be a reciprocating motor such as, for example, a split capacitor motor, that is rapidly reversed in direction to provide the reciprocating motion for agitator 40. In such arrangement, transmission 56 functions as a speed reducer rather than a reciprocating motion device.

As is conventional, washing machine 10 sequences through a spin cycle at the end of the wash cycle as well as at the end of a subsequent rinse cycle. During a spin cycle, the agitator drive shaft 62 and the spin tub drive shaft 64 are locked together and accelerated by motor 46 up to a high rotational speed such as 600–700 rpm while draining wash water from outer tub 32. In conventional manner, the clothes are thrown by centrifugal force against sidewall 38 of spin tub 34, and water from the clothes is extracted by centrifugal force through perforations 36. If the clothes were uniformly distributed around sidewall 38, the rotation of spin tub 34 would be substantially balanced. However, as is normally the case, the clothes are not uniformly distributed and the spinning of spin tub 34 creates unbalance or out-of-balance forces of some magnitude. For example, a relatively severe out-of-balance condition may typically be equivalent to a 5 pound weight attached to side wall 38 at some angular position approximately 2 to 4 inches above the bottom of spin tub 34.

Figure 2:
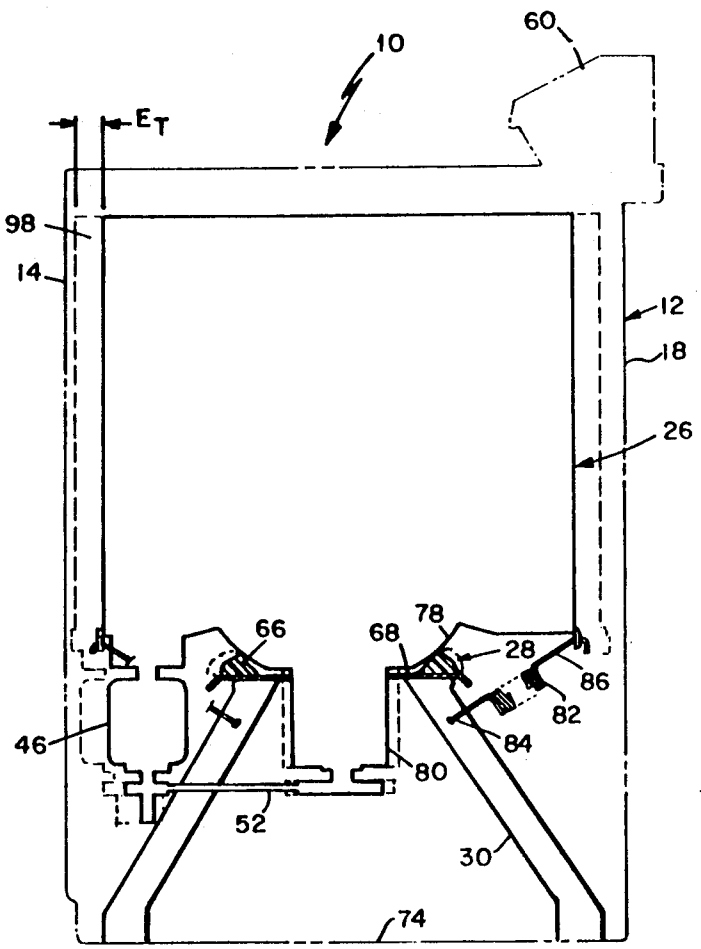
FIG. 2 is a diagrammatical drawing depicting the traversing mode of the washing machine suspension.

As described in detail in U.S. patent application Ser. No. 633,816 filed Dec. 26, 1990, which is hereby incorporated by reference, suspension 28 permits tub assembly 26 to move in two different modes or characteristics of motion in order to limit or restrict vibration of washer 10 caused by out-of-balance forces during a spin cycle. More specifically, suspension 28 here includes an annular donut-shaped traversing member or collar 66 that sits on a flat support disc 68 or plate having a large central aperture 70. As shown, disc 68 is connected to and supported at an approximate mid-level of washer 10 by upstanding legs 30. Here, four legs 30 are used, and each leg 30 slopes outwardly in the downward direction and has a lower end connected to base 74. Feet 76 are securely attached to the underside of base 74, and support the entire washing machine on the floor of the installation. Tub assembly 26, which here includes outer tub 32, spin tub 34, agitator 40, motor 46, and transmission 56 with drive shafts 62 and 64, has an inverted dome portion 78 that attaches to the bottom of outer tub 32. As shown, dome portion 78 has a spherical shape and sits on collar 66 with a housing portion 80 encasing transmission 56 extending downwardly through aperture 70. There is a low coefficient of friction between collar 66 and disc 68, and therefore collar 66 can slide laterally on the support surface of disc 68. Thus, as shown by the dotted outline in FIG. 2, one of the heretofore identified modes of motion is horizontal or traversing motion wherein tub assembly 26 sits on collar 66 as collar traverses in the x,y plane on disc 68. Tub assembly 26 is biased towards the center of aperture 70 by a set of centering springs 82 each having a dominant horizontal or x,y component. Although other arrangements could be used, each centering spring 82 has one end 84 connected to a respective leg 30 and an opposite end 86 connected to a downwardly extending flange 88 of outer tub 32. Thus, as a centrifugal force caused by an out-of-balance wash load during a spin cycle causes tub assembly 26 to traverse with collar 66 moving in sliding engagement on disc 68, the centering spring 82 in the direction of motion deflects thereby exerting on tub assembly 26 a reactive spring force directed back towards the center of aperture 70. It will be apparent that if the out-of-balance force is radially outward between two centering springs 82, then the reactive spring force will be x,y components or vectors from those two centering springs 82. It is also apparent that as the out-of-balance force rotates with the spin tub 34, tub assembly 26 will traverse in a circular motion as shown in FIG. 4.

Figure 3:
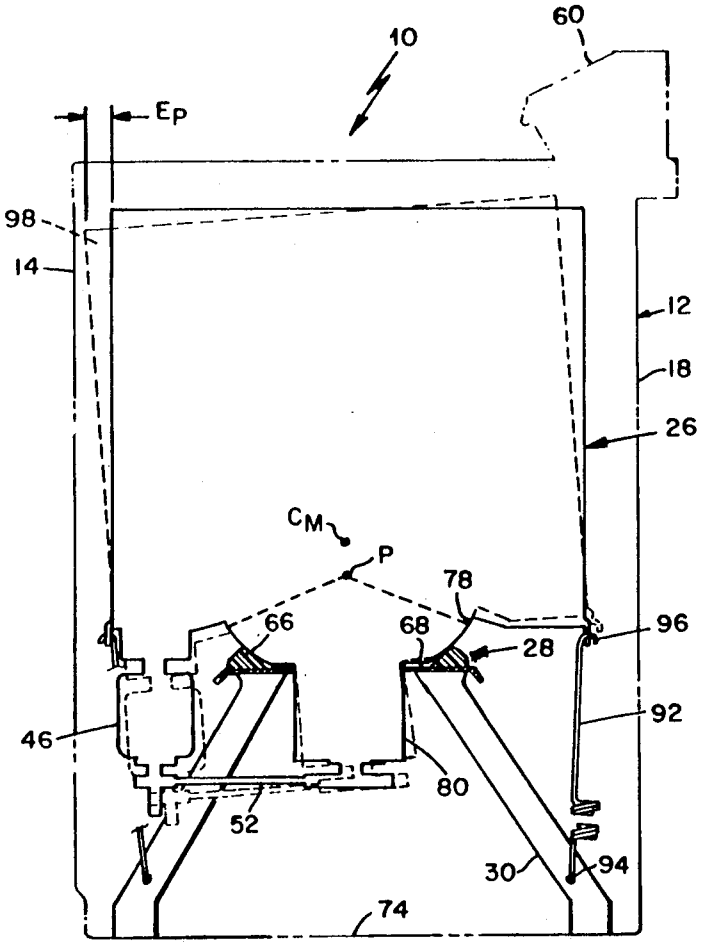
FIG. 3 is a diagrammatical drawing depicting the pivoting mode of the washing machine suspension.

Still referring to FIG. 1 and also to FIG. 3, the other mode or characteristic of motion is a tilting or pivoting motion. Dome portion 78 has a substantially spherical surface that sits on collar 66, and thus tub assembly 26 has freedom to tilt or pivot on collar 66. Preferably, collar 66 has an annular bead 90 as shown in FIG. 1 which supports dome portion 98 thereby minimizing the surface contact area between dome portion 78 and collar 66. Tub assembly 26 is biased toward a vertical or upright orientation by a set of upstanding springs 92 having a dominant vertical or z component. Although other arrangements could be used, each upstanding spring 92 has one end 94 connected to a respective leg 30 adjacent base 74 with the opposite end 96 connected to downwardly extending flange 88 of outer tub 32. Thus, as a centrifugal force caused by an out-of-balance wash load during a spin cycle causes tub assembly 26 to tilt or pivot on collar 66, the upstanding spring 92 on the opposite side deflects exerting on tub assembly 26 a reactive spring force directed back towards an upstanding orientation. It is apparent that if the out-of-balance force is between two springs 92, then the reactive spring force will be components or vectors from the two upstanding springs 92 on the opposite side. With the arrangement described heretofore, the tilting or pivoting forces on tub assembly 26 caused by a given out-of-balance condition are reduced by having the heretofor described independent traversing mode of motion.

As shown in FIG. 3, tub assembly 26 has a pivot point P generally defined by the center of the spherical surface of dome portion 78. That is, as tub assembly 26 pivots, the center of rotation is about the pivot point P defined by the center of the sphere. Here, tub assembly 26 has a static center of mass Cm located above pivot point P. With such arrangement, tub assembly 26 is not self-righting so upstanding springs 92 have a relatively high spring rate (force to deflect per unit distance). An advantage of having the static center of mass Cm of tub assembly 26 located above the pivot point P is that the dynamic center of mass will be closer to the out-of-balance weight which, for example, may typically be 2–4 inches above the bottom of spin tub 34. With such arrangement, the pivoting or tilting forces are minimal as are the vertical forces transmitted to feet 76. In such manner, washing machine 10 has less tendency to walk or vibrate during a spin cycle. However, because the dynamic center of mass of tub assembly 26 is above the pivot point P, tub assembly 26 traverses and pivots in the same instantaneous radial direction. More specifically, with reference to FIG. 4, the pictorial diagram shows the out-of-balance weight located at $W_{t1}$ at time $t_1$. At this location, the traversing excursion $E_T$ is in the outward radial direction and, because the dynamic center of mass is above the pivot point P, the pivoting excursion $E_P$ is also in the same direction. It can also be seen that as the out-of-balance weight rotates around to locations $W_{t2}$ and $W_{t3}$ at respective times $t_2$ and $t_3$, the pivoting excursion $E_P$ always aligns with or is in the same direction as the traversing excursion $E_T$. In other words, with the heretofore described arrangement, the transverse excursion $E_T$ and pivoting excursion $E_P$ are additive so that the total excursion $E_{TOTAL}=E_T+E_P$. As a result, a larger free motion envelope 98 is required between static tub assembly 26 and cabinet 12 than would be necessary if the pivoting excursion $E_P$ and traversing excursion $E_T$ were instantaneously in different or out of phase directions (i.e. not additive).

In accordance with the invention, the sets of centering springs 82 and upstanding springs 92 are selected so that the traversing motion and pivoting motion of tub assembly 26 do not have the same critical speed or frequency. That is, centering springs 82 and uprighting springs 92 are selected so that the maximum traversing excursion $E_T$ occurs at a different time or rpm than the maximum pivoting excursion $E_P$ as the spin tub 26 accelerates up to spin speed. This is important because it minimizes the maximum total excursion $E_{TOTAL}$ and therefore, the free motion envelope 98 between a static tub assembly 26 and cabinet 12 does not have to be so large as it otherwise would have to be.

Stated differently, the suspension 28 permits the respective traversing and pivoting modes of motion to have maximum permissible excursions so as to optimize suspension performance (i.e. reduce forces transmitted to feet 76), but the respective maximum excursions $E_T$ and $E_P$ are managed so that they occur at different times (i.e. different rpm's) so as to minimize the total excursion occurring at any time during the acceleration of spin tub 34.

Referring to FIG. 5, an illustrative plot is shown for tub assembly 26 excursion versus rotational speed of the spin tub 34. Here, as an example, it is assumed that during the design of a washing machine, an excursion limit is set for 1.25". That is, for the particular washing machine 10 of interest, it has been determined that it would be desirable to have the maximum instantaneous total excursion (i.e. traversing excursions $E_T$ plus pivoting excursions $E_P$) less than 1.25" in order to prevent mechanical interference with the cabinet 12. As shown in FIG. 5, the critical speed of the traversing motion $CS_T$ and the pivoting motion $CS_P$ occur at the same rotational speed such as, for example, a speed in the range from 50–150 rpm, although not numerically labelled here. As described heretofore with reference to FIG. 4, the traversing excursions $E_T$ and the pivoting excursion $E_P$ generally occur in the same instantaneous radial direction when the dynamic center of mass and the out-of-balance weight are both above the pivot point P. Thus, as shown in FIG. 5, the total excursion $E_{TOTAL}$ is the sum of traversing excursion $E_T$ and pivoting excursion $E_P$. In the example of FIG. 5, the total excursion $E_{TOTAL}$ here exceeds the predetermined excursion limit of 1.25" because the respective maximum excursions $E_T$ and $E_P$ occur at the same speed.

Referring to FIG. 6, centering springs 82 and upstanding springs 92 are selected so that the critical speed (i.e. speed of maximum excursion) for pivoting $CS_P$ occurs at a different speed than the critical speed for traversing $CS_T$. That is, the maximum traversing excursion $E_T$ occurs at a different rotational speed than the maximum pivoting excursion $E_P$. With such arrangement, the maximum total excursion is less than shown for similar parameters in FIG. 5 because the peaks of the curves do not coincide in time. Thus, the suspension system stays within the predetermined instantaneous excursion limit of 1.25". In short, during the acceleration of spin tub 34 up to spin speed, the motion of tub assembly 26 can be characterized as primarily traversing motion up to a maximum traversing excursion $E_T$ at the critical traversing speed $CS_T$ while undergoing minimal pivoting, and then primarily pivoting motion up to a maximum pivoting excursion $E_P$ at the critical pivoting speed $CS_P$ after the traversing motion has diminished. Thus, the maximum traversing and pivoting excursions occur at different times thereby minimizing the total excursion $E_{TOTAL}$ occurring at any instantaneous time.

Designing a multi-mode suspension system that has different critical speeds for the different modes can be accomplished empirically, by calculation, or, more likely by a combination of both. The critical speed of a mechanical spring mass system may be defined as:

$$C_s = 60/2\pi \sqrt{\frac{(k)(gc)}{M}}$$

where $C_s$ is the critical speed (rev/min), K is the system spring rate (lbf/ft), M is the system mass (lbm), and gc is the gravitational constant (lbm-ft/lbf-sec$^2$).

As it can be seen, the critical speed is a function of system mass and system spring rate. System mass is the mass of the tub assembly 26 including all of the parts which move as a substantially rigid unit. The system mass is largely established by design considerations other than the resulting excursions can be studied for the respective modes of motion. Then, the spring rates of centering springs 82 and upstanding springs 92 can be changed to provide optimal suspension performance (i.e. minimum of out-of-balance forces transmitted to feet) with minimum of total excursion. Thus, the free motion envelope 98 can be limited so that the size of cabinet 12 can be minimized.

This concludes the description of the preferred embodiment. A reading of it by those skilled in the art, however, will bring to mind many alterations and modifications that do not depart from the spirit and scope of the invention. Therefore, it is intended that the scope of the invention be limited only by the appended claims.

What is claimed is:

1. A suspension system adapted for supporting a tub assembly comprising a spin tub disposed in a outer tub within a washing machine wherein the spin tub is accelerated to a predetermined high speed rotation during a spin cycle of the washing machine, said suspension system comprising:

means for permitting motion of said tub assembly in first and second modes; and means for biasing motion of said tub assembly in said first and second modes so that the maximum excursion of said first mode occurs at a different spin tub rotational speed than maximum excursion of said second mode.

2. The system recited in claim 1 wherein said first mode permitting means comprises means for traversing said tub assembly in a substantially horizontal plane.

3. The system recited in claim 1 wherein said second mode permitting means comprises means for pivoting said tub assembly.

4. The system recited in claim 3 wherein said tub assembly has a dynamic center of mass disposed above a pivot point of said pivoting motion.

5. The system recited in claim 1 wherein said first and second mode biasing means comprises a first set of springs for biasing said tub assembly towards a predetermined location on a horizontal plane and a second set of springs for biasing said tub assembly towards an upright orientation.

6. The system recited in claim 5 wherein said first and second sets of springs comprise means for providing different critical speeds for said first and second modes

7. The system recited in claim 6 wherein said first and second sets of springs have different spring rates.

8. A suspension system adapted for supporting a tub assembly in a washing machine wherein the tub assembly comprises a spin tub disposed in an outer tub, and the spin tub is accelerated to a predetermined rotational speed during a spin cycle of the washing machine, said suspension system comprising:

a support surface;

a traversing member comprising a collar supported in sliding engagement on said support surface, said collar comprising means for pivotally supporting said tub assembly;

means comprising a first set of springs for biasing said tub assembly towards a central position on said support surface;

means comprising a second set of springs for biasing said tub assembly towards an upright orientation; and said first and second sets of springs comprising means for providing substantially different critical speeds for traversing and pivoting to provide maximum excursion of traversing at a different spin tub speed than maximum excursion of pivoting.

9. The system recited in claim 8 wherein said tub assembly has a dynamic center of mass disposed above the pivot point of said tub assembly.

10. The system recited in claim 8 further comprising means for elevating said support surface above a base of said washing machine.

11. The system recited in claim 10 wherein said elevating means comprises a plurality of upstanding legs.

12. The system recited in claim 11 wherein each spring of said sets of springs has one end connected to a respective one of said legs and an opposite end connected to said tub assembly.

13. The system recited in claim 12 wherein each spring of said second set of springs has one end connected to a respective one of said legs at a location below a corresponding spring of said first set of springs.

14. The system recited in claim 8 wherein the higher of said critical speeds is more than 25% higher than the lower of said critical speeds.

15. The system recited in claim 8 wherein one said critical speeds is less than 50 rpm and the other of said critical speeds is greater than 60 rpm.

16. The system recited in claim 8 wherein said critical speeds are separated by more than 10 rpm.

17. A washing machine comprising:

an outer cabinet;

a tub assembly comprising a spin tub and outer tub disposed in said cabinet;

means for accelerating said spin tub to a predetermined spin speed during a spin cycle of said washing machine to extract moisture from clothes positioned in said spin tub;

a suspension comprising means for permitting motion of said tub assembly during one of said spin cycles in independent first an second modes of motion; and said suspension further comprising a first set of springs biasing said first mode of motion and a second set of springs biasing said second mode of motion, said first and second sets of springs having different system spring rates to provide maximum excursion of said first mode of motion at a different critical speed of said spin tub than maximum excursion of said second mode of motion.

18. The washing machine recited in claim 17 wherein said first mode of motion is a traversing motion in a substantially horizontal plane.

19. The washing machine recited in claim 17 wherein said second mode of motion is a pivoting motion.

20. The washing machine recited in claim 19 wherein the dynamic center of mass of said tub assembly is disposed above the pivoting point of said second mode of motion.

21. The washing machine recited in claim 17 further comprising upstanding legs elevating said suspension to approximate mid-level of said washing machine.

22. The washing machine recited in claim 17 wherein each of said springs of said first set of springs has a spring rate of approximately 4 lbs./inch.

23. The washing machine recited in claim 17 wherein each of said springs of said second set of springs has a spring rate of approximately 8 lbs./inch.

24. A method of fabricating a washing machine, comprising the steps of:

providing a tub assembly comprising a spin tub positioned in an outer tub;

providing a drive for accelerating said spin tub to a high rotational speed during a spin cycle of said washing machine;

providing a suspension that permits said tub assembly to move in a traversing motion and a pivoting motion independently;

selecting a first set of suspension springs with a first system spring rate to bias said tub assembly traversing motion so that, as said spin tub accelerates, the maximum traversing motion occurs at a first spin tub speed; and selecting a second set of suspension springs having a second system spring rate to bias said tub assembly pivoting so that, as said spin tub accelerates, the maximum pivoting excursion occurs at a second spin tub speed different than said first speed.

25. The method recited in claim 24 wherein said first and second spin tub speeds differ by more than 10 rpm.

26. The method recited in claim 24 wherein the higher of said first and second spin tub speeds is more than 25% above the lower.

* * * * *